US009252529B2

(12) United States Patent
Cho et al.

(10) Patent No.: US 9,252,529 B2
(45) Date of Patent: Feb. 2, 2016

(54) CONNECTOR FOR FLAT CABLE

(71) Applicants: Hyundai Motor Company, Seoul (KR); Yura Corporation Co., Ltd, Cheongwon Gun, Chungcheongbuk-Do (KR); Hirose Korea Co., Ltd., Siheung, Gyeonggi-Do (KR)

(72) Inventors: Ha Young Cho, Gyeonggi-do (KR); Jun Seo Park, Gyeonggi-do (KR); Young Jong Lee, Seoul (KR); Se Kwun Kim, Chungcheongbuk-do (KR); Kyung June Kim, Gyeonggi-do (KR)

(73) Assignees: Hyundai Motor Company, Seoul (KR); Yura Corporation Co., Ltd., Cheongwon-gun (KR); Hirose Korea Co., Ltd., Siheung (KR)

( * ) Notice: Subject to any disclaimer, the term of this patent is extended or adjusted under 35 U.S.C. 154(b) by 0 days.

(21) Appl. No.: 14/319,335

(22) Filed: Jun. 30, 2014

(65) Prior Publication Data

US 2015/0162700 A1 Jun. 11, 2015

(30) Foreign Application Priority Data

Dec. 6, 2013 (KR) ..... 10-2013-0151589

(51) Int. Cl.

| | |
|---|---|
| ***H01R 3/00*** | (2006.01) |
| ***H01R 13/58*** | (2006.01) |
| ***H01R 12/61*** | (2011.01) |

(52) U.S. Cl.

CPC ..... *H01R 13/5812* (2013.01); *H01R 12/613* (2013.01)

(58) Field of Classification Search

CPC .... H01R 12/78; H01R 23/668; H01R 23/684; H01R 12/774

USPC ..... 439/496, 495, 67, 77

See application file for complete search history.

(56) References Cited

U.S. PATENT DOCUMENTS

| | | | | |
|---|---|---|---|---|
| 6,039,600 | A * | 3/2000 | Etters et al. | 439/496 |
| 7,172,455 | B2 * | 2/2007 | Pabst et al. | 439/496 |
| 2003/0073345 | A1 * | 4/2003 | LePottier et al. | 439/496 |

FOREIGN PATENT DOCUMENTS

| | | | |
|---|---|---|---|
| JP | 4-123093 | U | 6/1992 |
| JP | 11-329622 | A | 11/1999 |
| JP | 2002110272 | A | 4/2002 |
| JP | 2002319444 | A | 10/2002 |
| KR | 10-2006-0133902 | | 12/2006 |
| KR | 10-2008-0003254 | | 1/2008 |

* cited by examiner

*Primary Examiner* — Phuong Dinh

(74) *Attorney, Agent, or Firm* — Mintz Levin Cohn Ferris Glovsky and Popeo, P.C.; Peter F. Corless

(57) ABSTRACT

A connector for a flat cable is provided that prevents damage to a conductor when a terminal is forcedly pressed to a flat cable. The connector for a flat cable includes a retainer that is coupled to flat cable while a portion of the flat cable covers an upper side of a plate-shaped body of the retainer. In addition, a housing is coupled to enclose the body of the retainer and the portion of the flat cable coupled to the body and has a plurality of exposure depressions for exposing exposed conductors at a portion of the flat cable coupled to opposite surfaces of the body to the exterior to connect the conductors to terminals. A position fixing unit is configured to fix a position of the flat cable coupled between the housing and the retainer.

8 Claims, 10 Drawing Sheets

CONNECTOR FOR FLAT CABLE

CROSS-REFERENCE TO RELATED APPLICATION

This application claims under 35 U.S.C. §119(a) the benefit of Korean Patent Application No. 10-2013-0151589, filed on Dec. 6, 2013, the entire contents of which are incorporated herein by reference.

BACKGROUND (a) Technical Field

The present invention relates to a connector for a flat cable. More particularly, the present invention relates to a connector for a flat cable that prevents damage of a conductor caused by forcedly pressing a terminal to a flat cable.

(b) Background Art

In recent years, flexible flat cables (FFCs) having improved flexibility are being widely used in wirings of electronic devices and wirings of actuating parts for the purpose of saving space (e.g., maximizing space utilization) and simplifying connections due to decrease in size of the electronic devices. In general, flexible flat cables are also referred to as flat cables or multi-core cables, and are widely used in connecting a computer and its peripheral devices, a television, an official replicator, a digital device, and an electronic device and its components of a vehicle. The flexible flat cable has an excellent flexibility, and may be used in actuated components.

FIG. 1 is an exemplary view showing a coupling structure of a flat cable and a terminal according to the related art, and shows a conventional method of connecting and coupling a conductor of a flat cable and a terminal. As shown, in a conventional method of contacting and coupling a flat cable 1 and a terminal 2, a pressing part 2*a* of a terminal 2 passes through the flat cable 1 and a conductor 1*a* of the flat cable is forcedly pressed and coupled. A current may flow between the terminal 2 and the flat cable 1 by pressing the pressing part 2*a* and the conductor 1*a* together.

However, when the shown coupling structure is applied, the conductor of the flat cable may be damaged while forcedly passing the terminal through the conductor of the flat cable while the flat cable and the terminal are fastened. Further, a defect in a pressing position, that is, distortion of a terminal and a conductor when the terminal and the conductor are pressed may be caused, and since the terminal and the conductor may be pressed at a proper position (e.g., at the appropriate alignment), a pressing defect may be caused and thus a contact defect may occur. Additionally, in the conventional terminal pressing method, as a process of pressing terminals on a flat cable is required, a manufacturing process thereof is complex and production efficiency may decrease.

SUMMARY

Accordingly, the present invention provides a connector for a flat cable that prevents damage to a conductor of a flat cable and pressing defects caused by forcedly pressing terminals on a flat cable. It addition the present invention provides a connector for a flat cable by which a defect may be reduced, the number of processes may decrease, and raw prices may be reduced compared to a method of individually pressing the terminals.

In accordance with an aspect of the present invention, a connector for a flat cable may include: a retainer coupled to flat cable while a portion of the flat cable (e.g., a first portion) covers an upper side of a plate-shaped body of the retainer; a housing coupled to enclose the body of the retainer and the portion of the flat cable coupled to the body and having exposure depressions for exposing exposed conductors at a portion of the flat cable (e.g., a second portion) coupled to opposite surfaces of the body to the exterior to connect the conductors to terminals; and a position fixing unit configured to fix a position of the flat cable coupled between the housing and the retainer.

The housing may have a case shape that accommodates the body of the retainer and the portion of the flat cable coupled to the body, and may be coupled to the retainer and the flat cable to enclose (e.g., entirely enclose) the body of the retainer and the portion of the flat cable by the housing. The exposure depressions of the housing may be formed on opposite surfaces of the housing to reveal (e.g., expose) the exposed conductors at the portion of the flat cable coupled to opposite surfaces of the body of the retainer. In addition, the exposure depressions of the housing may be formed along a lengthwise direction of the exposed conductors at the portion of the flat cable, and may be formed in parallel to expose the parallel conductors at the portion of the flat cable coupled to the body. Partition parts between neighboring exposure depressions of the housing may be formed as a substantially straight line, and the partition parts may guide the terminals when the terminals formed lengthily are inserted into the exposure depressions for connection to the conductors in the housing. The partition parts of the housing may be configured to attach the flat cable located within the housing to the body of the retainer.

Further, the position fixing unit may include position fixing bosses formed in the body of the retainer to be inserted into the insertion bores of the flat cable. The position fixing bosses may be inserted into fixing apertures passing through the insertion bores of the flat cable and fixing apertures formed in the housing. In addition, the position fixing bosses may be formed at an end of the body of the retainer covered by the flat cable along a widthwise direction of the body at a predetermined separation, and the fixing apertures may be formed within the housing on a corresponding surface of the end of the body at a predetermined separation. Further, the retainer may include: a body inserted into and coupled to the housing and plate-shaped such that the portion of the flat cable is folded into a U shape to be attached and coupled to the body between the housing and the body; and a flange integrally formed with one side of the body and coupled to the housing.

According to the connector for a flat cable of the present invention, a flat cable may be inserted into and coupled to a housing and a retainer, the position of the flat cable may be fixed by bosses and apertures in a coupled structure of the housing and the retainer, and terminals may be connected to opposite surfaces of a conductor exposed to opposite surfaces of the housing. Thus, the flat cable may be more stably fixed in the connector, and problems such as damage of the conductor and a connection defect may be prevented compared to a method of inserting the terminals into the flat cable and pressing the terminals according to the related art.

In particular, since two contact points may be provided between the flat cable and the terminal, connection reliability may be improved and a connection defect of the terminals and the conductors may be prevented by guides for preventing the terminals from being inserted incorrectly (e.g., at an incorrect alignment). Further, the assembly process may be simplified, the number of processes may be reduced, productivity may be improved, and raw prices may be reduced compared to a method of inserting terminals into the flat cable and pressing the terminals according to the related art.

BRIEF DESCRIPTION OF THE DRAWINGS

The above and other features of the present invention will now be described in detail with reference to certain exemplary embodiments thereof illustrated the accompanying drawings which are given hereinafter by way of illustration only, and thus are not limitative of the present invention, and wherein.

Figure 1:
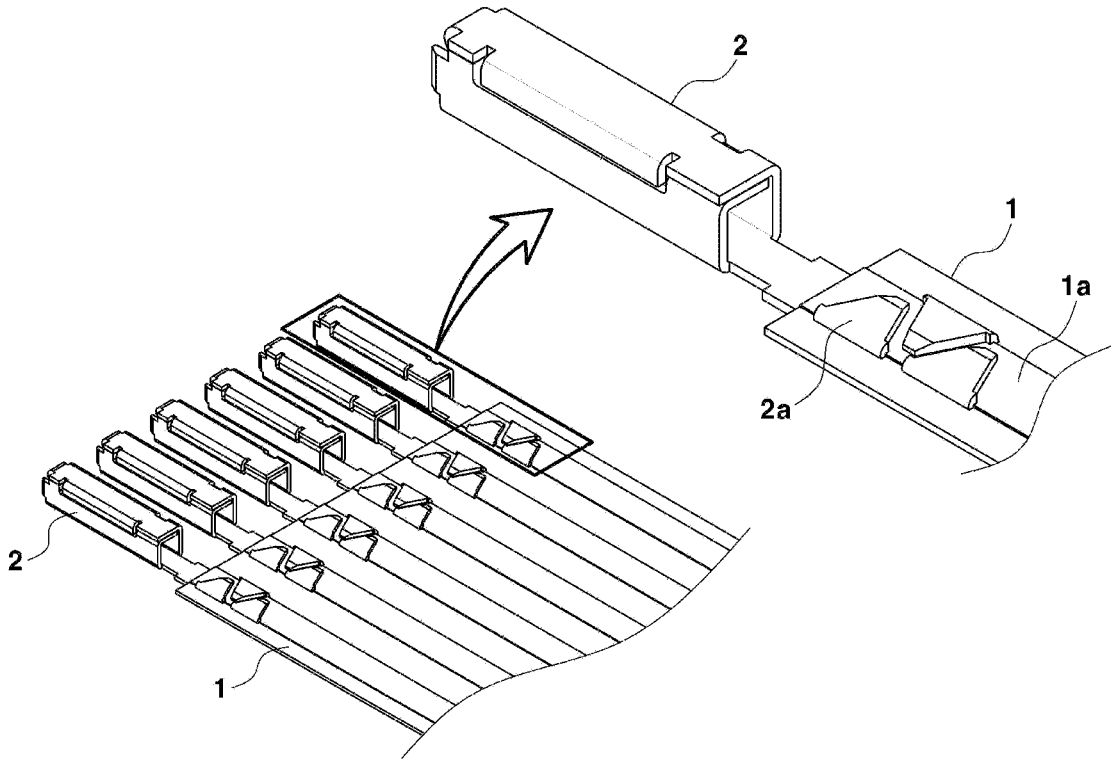
FIG. 1 RELATED ART
FIG. 1 is an exemplary view showing a coupling structure of a flat cable and a terminal according to the related art.

It should be understood that the accompanying drawings are not necessarily to scale, presenting a somewhat simplified representation of various exemplary features illustrative of the basic principles of the invention. The specific design features of the present invention as disclosed herein, including, for example, specific dimensions, orientations, locations, and shapes will be determined in part by the particular intended application and use environment. In the figures, reference numbers refer to the same or equivalent parts of the present invention throughout the several figures of the drawing.

DETAILED DESCRIPTION

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g., fuels derived from resources other than petroleum).

Hereinafter, an exemplary embodiment of the present invention will be described in detail with reference to the accompanying drawings so that those skilled in the art to which the present invention pertains may easily carry out the present invention. However, the present invention is not limited to the exemplary embodiment, but may be applied in various forms without departing from the spirit of the present invention. The present invention may include constituent elements other than the elements that will be described below if necessary, and parts that are directly relevant to the present invention or repeated contents will not be described in detail. The disposition of the elements described in the specification may be adjusted if necessary, and one element may be included in another element or may be divided into at least two elements.

Figure 2:
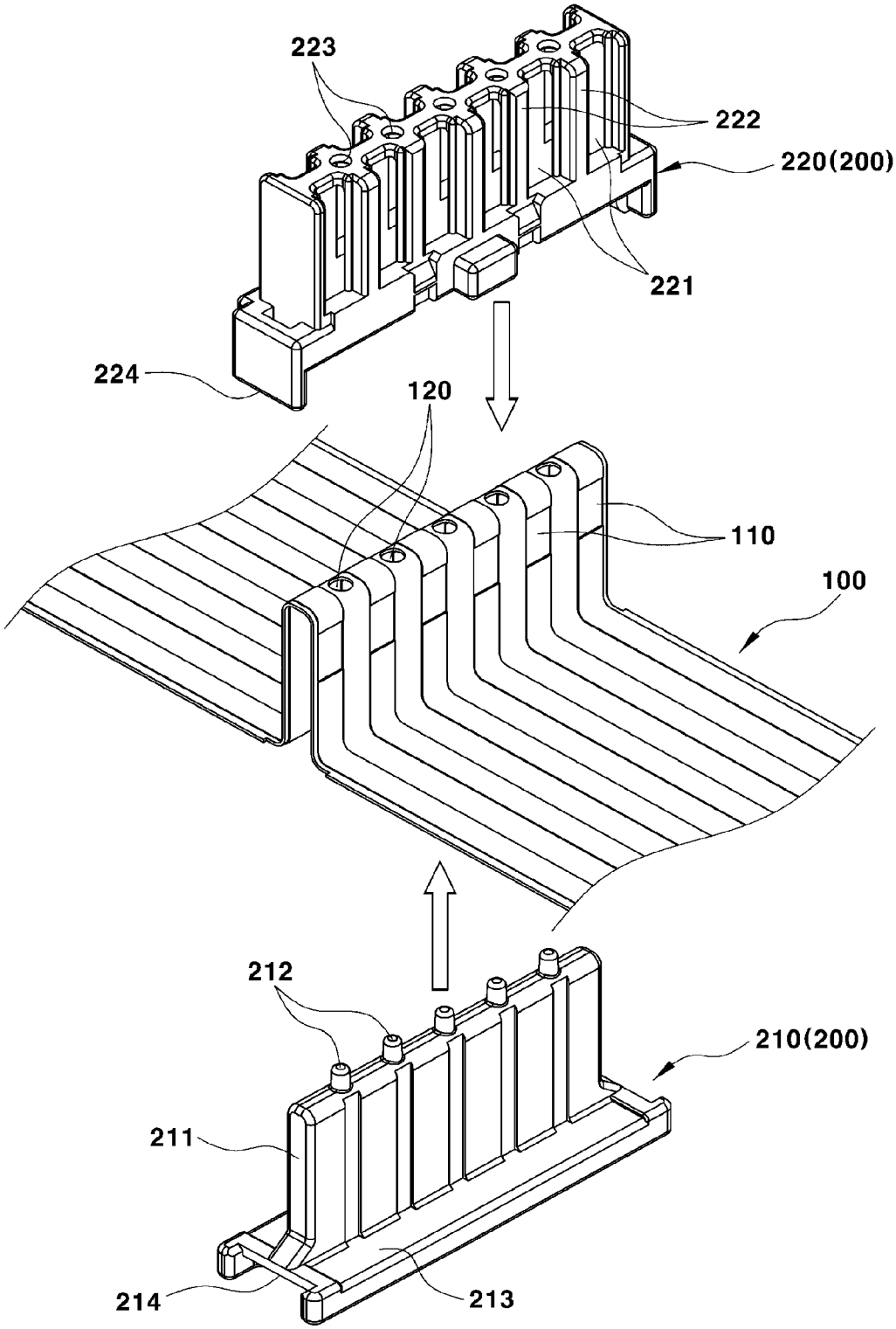
FIG. 2 is an exemplary detailed view showing a connector for a flat cable according to an exemplary embodiment of the present invention.
Figure 3:
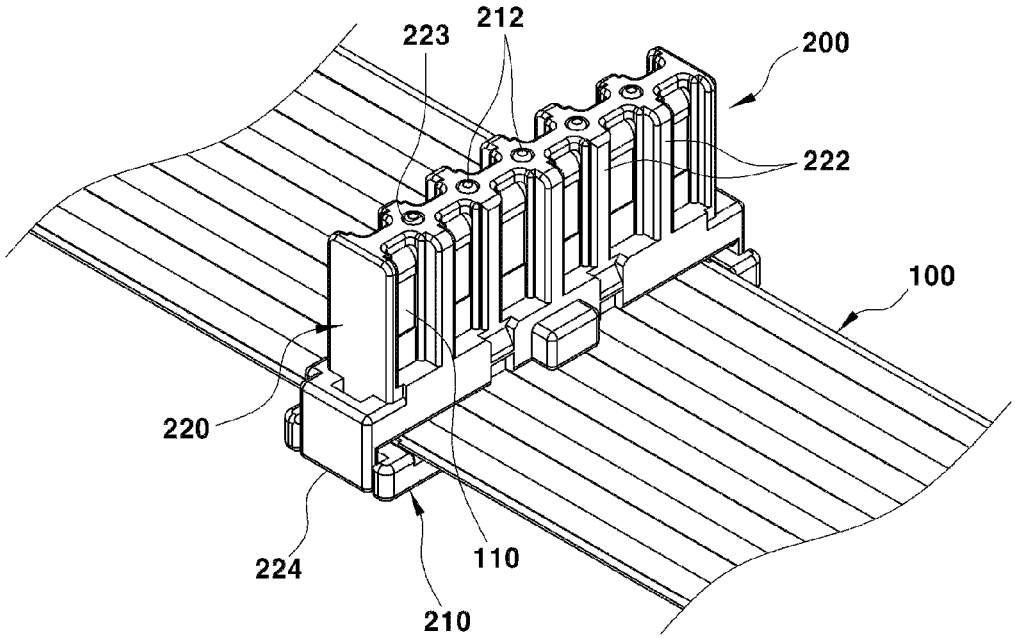
FIG. 3 is an exemplary view showing a connector for a flat cable according to the exemplary embodiment of the present invention.

FIG. 2 is an exemplary detailed view showing a connector for a flat cable according to an exemplary embodiment of the present invention. FIG. 3 is an exemplary view showing a connector for a flat cable according to the exemplary embodiment of the present invention. As shown, the connector 200 (in the form of a male connector) according to the exemplary embodiment of the present invention may include a retainer 210 and a housing 220.

Figure 8:
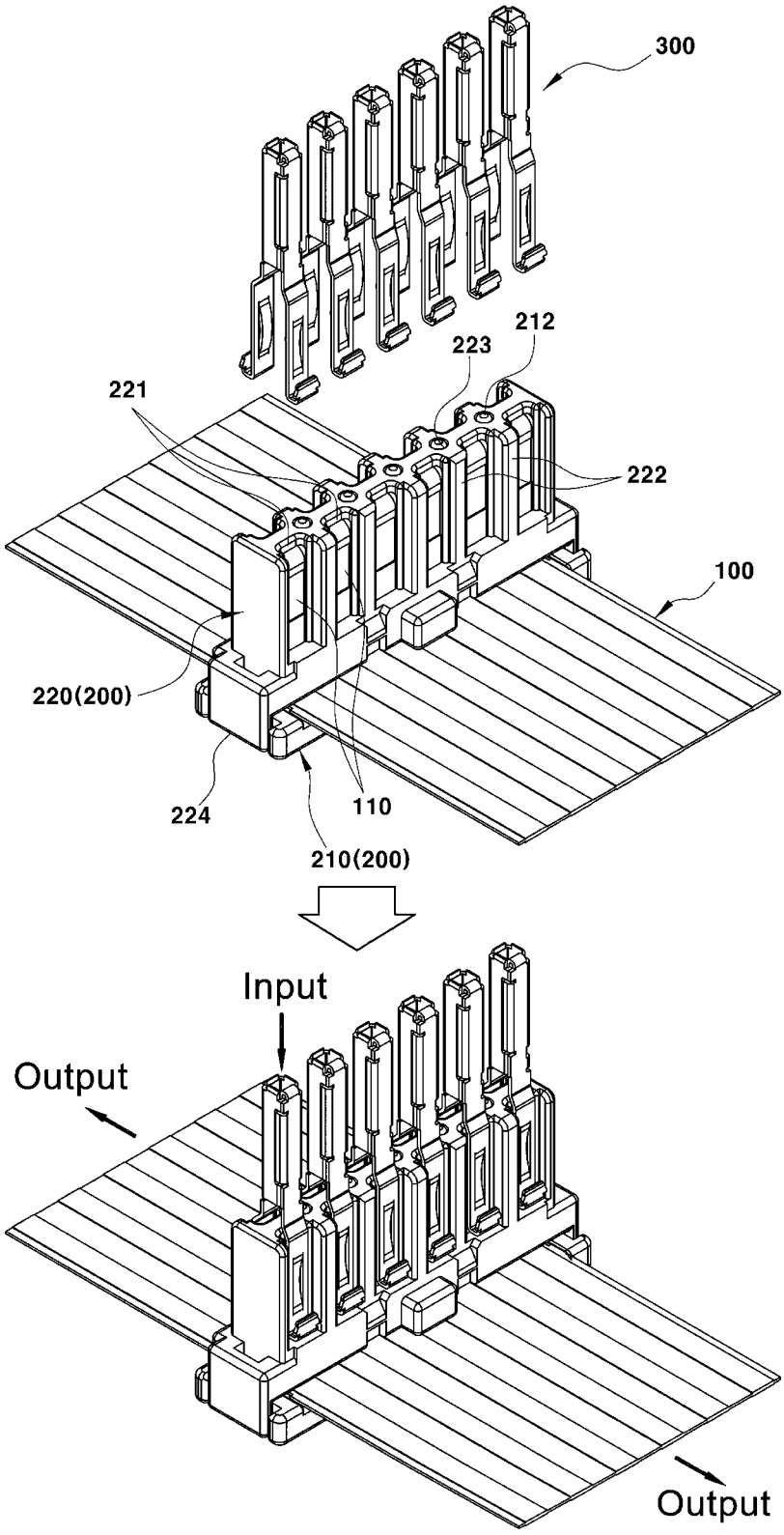
FIG. 8 is an exemplary view a terminal connected to the connector according to the exemplary embodiment of the present invention.

A structure in which a flat cable 100 is coupled to the connector 200 including a retainer 210 and a housing 220 and a terminal 300 (e.g., a terminal of a female connector as shown in FIG. 8 may directly contact a conductor 110 of the flat cable 100 by improving a method of fastening the flat cable and the terminal through penetration and pressing using a pressing terminal is applied to the connector 200 according to the exemplary embodiment of the present invention. Thus, since a process of pressing an individual terminal may be eliminated, an assembly process may be more easily performed and a production efficiency may be improved.

In a description of the elements, the connector 200 may be a part to which the flat cable 100 may be fixed, and may include a retainer 210 and a housing 220 that connect the flat cable 100 and the terminal. The retainer 210 may be a part to which the flat cable 100 may be attached and coupled and that fixes the flat cable 100 within the housing 220. In addition, the retailer 210 may include a body 211 and a flange 213 integrally formed at one side of the body 211. Coupling parts 214 that couple the flange 213 to the housing 220 may formed at opposite widthwise ends of the flange 213. The body 211 of the retainer 210 may be a part to which the flat cable 100 folded in a U-shaped form is fixed while covering the body 211 of the retainer 210, and may be inserted into the housing when the retainer 210 is assembled with the housing 220. Opposite surfaces of the body 211 may be parts to which the flat cable 100 may be attached, and the flat cable 100 may be attached to an inner surface of the housing while the opposite surfaces of the body 211 are inserted into the housing 220.

When the flat cable 100 is coupled to the above elements, the flat cable 100 may cover an upper side of the retailer 210 after the flat cable 100 is folded into a U-shaped form, in which case the opposite surfaces of the flat cable 100 folded into a U-shaped form may cover upper sides of the opposite surfaces of the body 211 of the retainer 210 and an end of the folded part of the flat cable 100 may be coupled to an upper side of the end of the body 211 of the retainer 210. Since the flat cable 100 may maintain a fixed state without moving from the body 211 of the retainer 210, the retainer 210 may include a position fixing unit configured to fix a position of the flat cable 100 to prevent the flat cable 100 to be moved while being coupled.

In the exemplary embodiment of the present invention, the position fixing unit may be position fixing bosses 212 formed at an end of the body 211 of the retainer 210 along a widthwise direction of the cable (e.g., a widthwise direction of the retainer) by a predetermined separation, and the position fixing bosses 212 may be inserted into insertion bores 120 that pass through the flat cable 100. The insertion bores 120 of the flat cable 100 may be formed at (e.g., aligned with) portions of the cable that contact an end of the body 211 of the retainer 210, and more preferably, at portions of a covering part of the cable having no conductors 110. In other words, the insertion bores 120 may be formed at sides of the conductors at portions of the covering part that corresponds to the position fixing bosses (e.g., at positions where the position fixing bosses of the retainer may be inserted) along a widthwise direction of the cable by a predetermined separation.

Meanwhile, a plurality of conductors disposed in parallel along a lengthwise direction of the cable may be covered by a covering material, and the flat cable 100 may have a conductor 110 (e.g., a part to which a terminal may be connected) obtained by partially removing the covering material to connect the terminal 300 (see FIG. 8) to a portion of the flat cable 100 coupled to the connector 200, that is, a portion of the flat cable 100 coupled to the retainer 210 and the housing 220.

Figure 4:
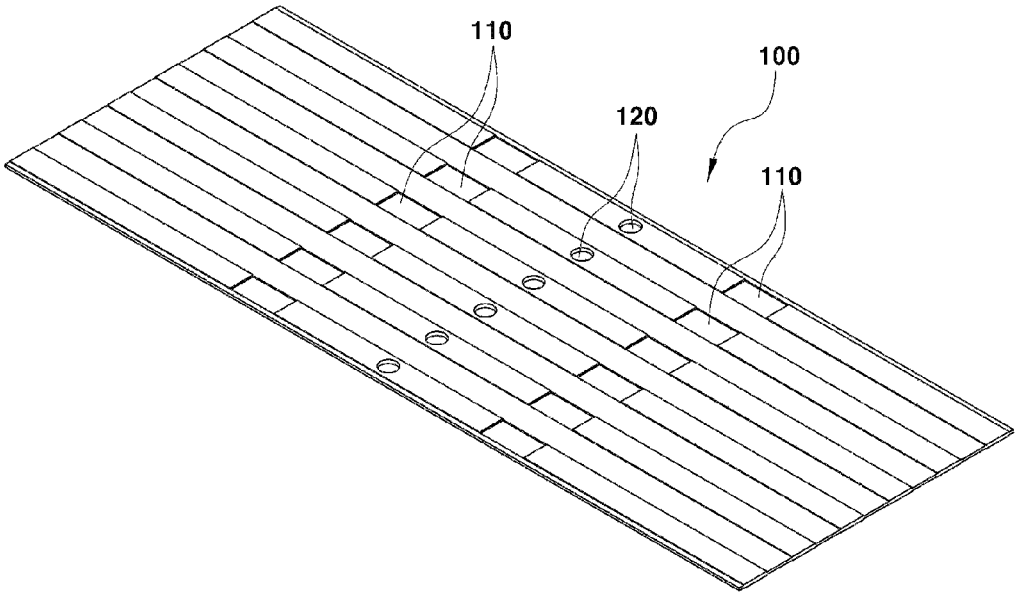
FIG. 4 is an exemplary view showing a flat cable coupled to connector according to the exemplary embodiment of the present invention.
Figure 5A:
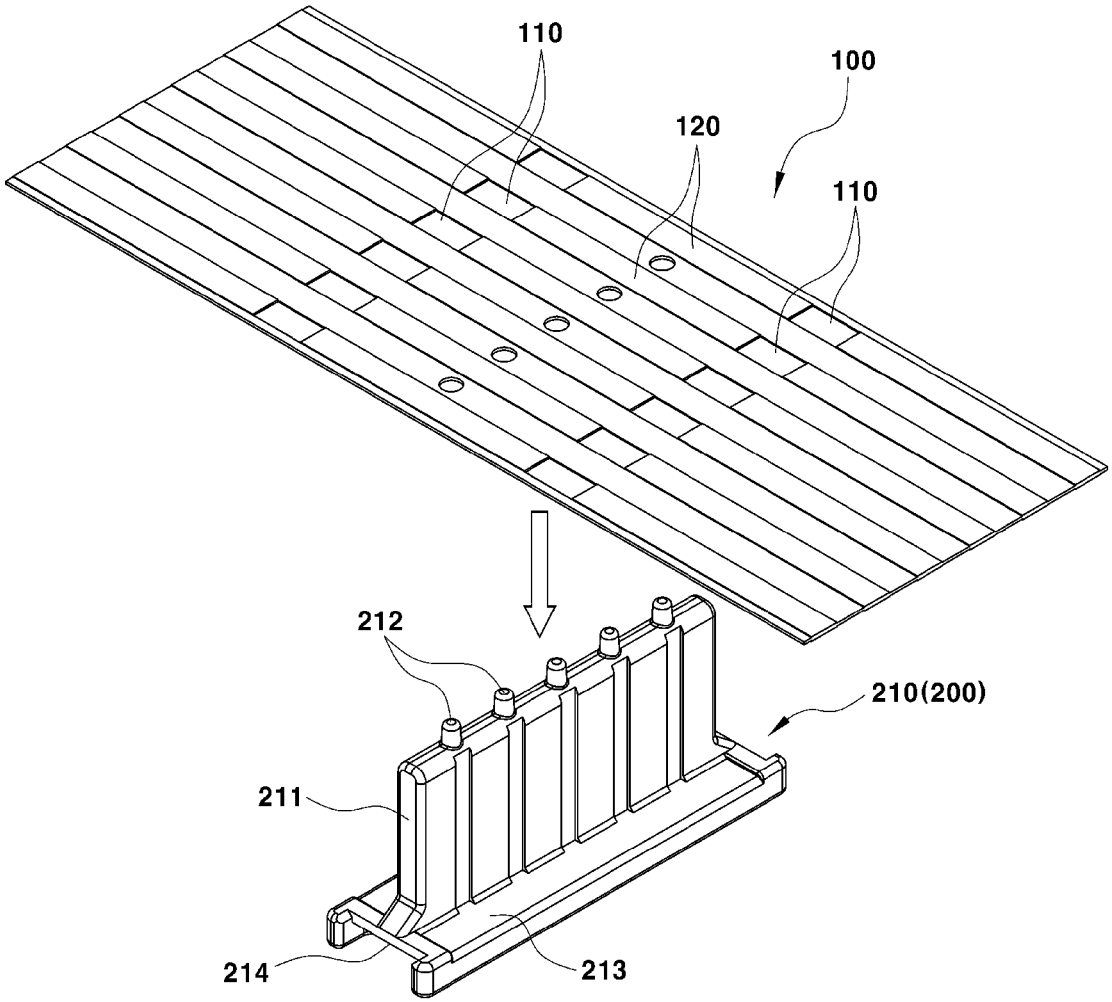
FIGS. 5A to 5E are exemplary views showing a process of assembling the connector and the flat cable according to the exemplary embodiment of the present invention.
Figure 5B:
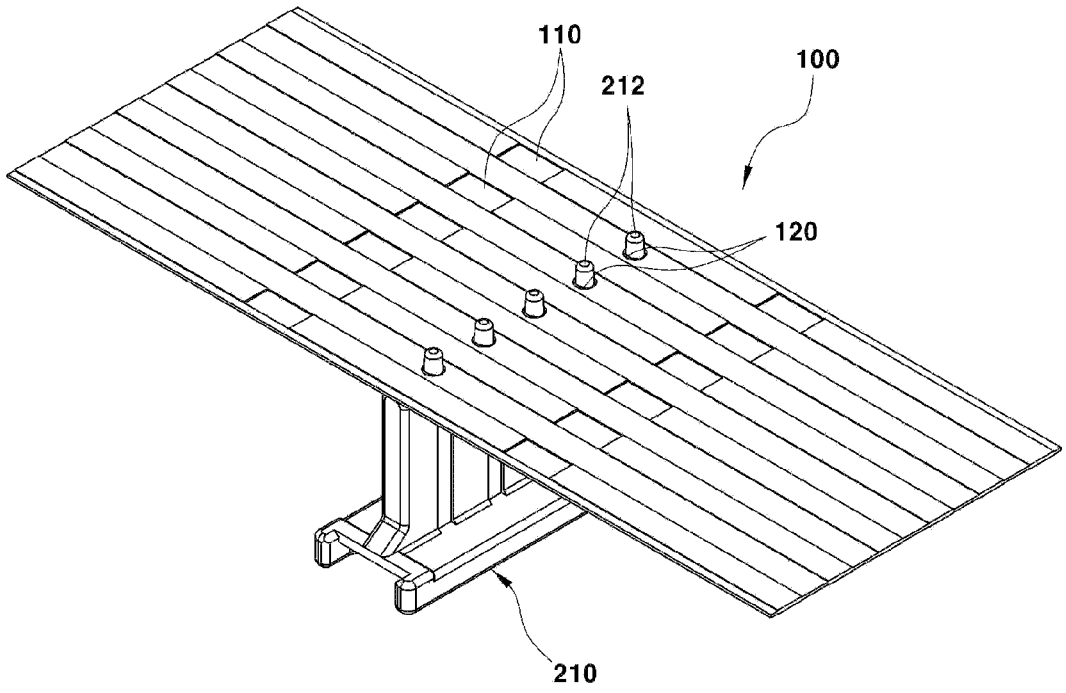
Figure 5C:
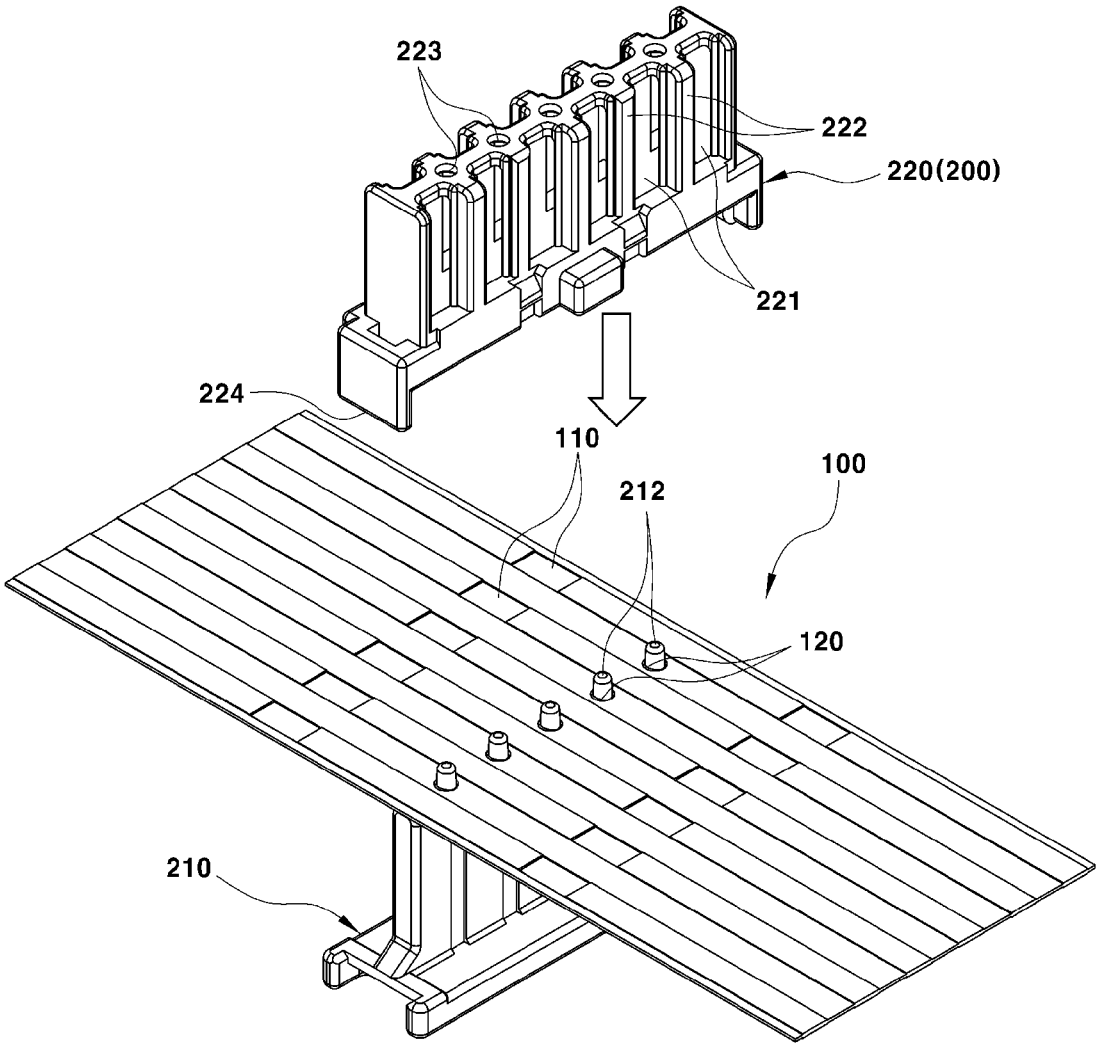
Figure 5D:
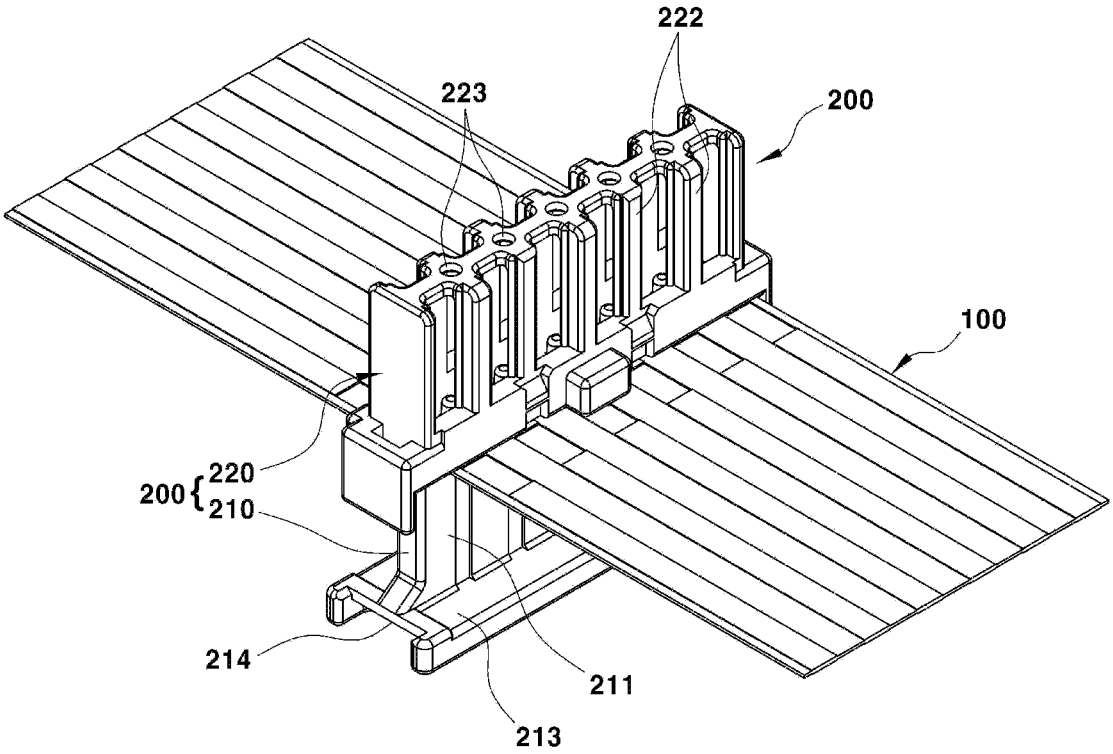
Figure 5E:
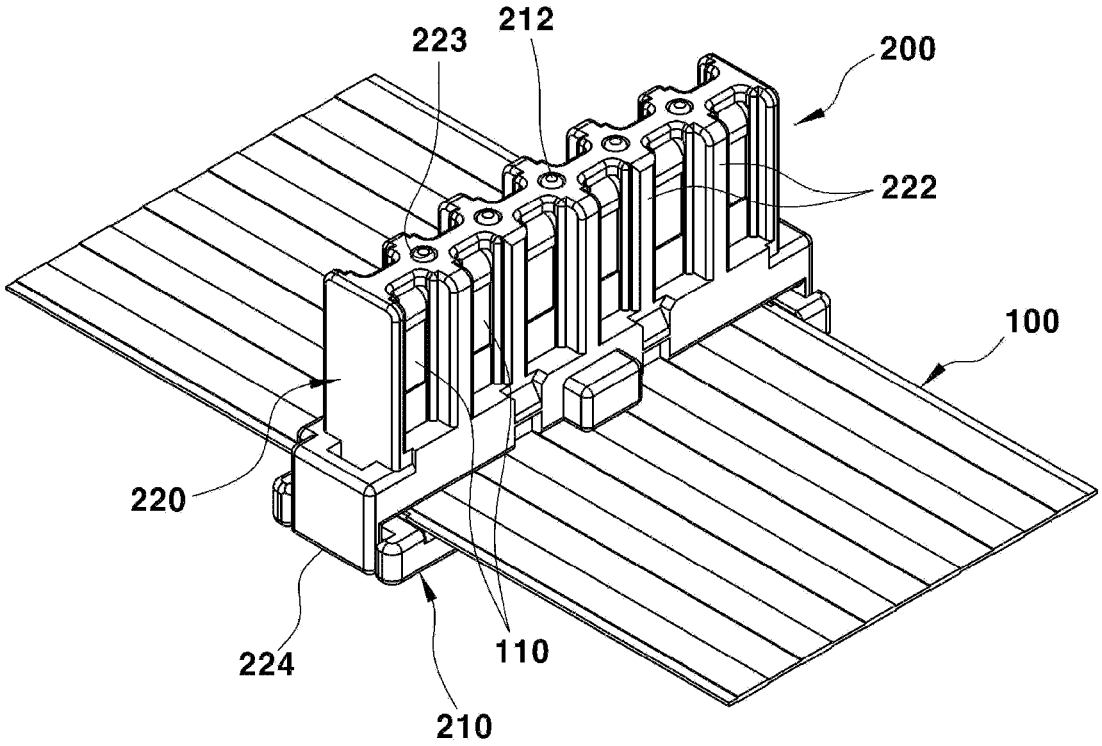

FIG. 4 is an exemplary view showing a flat cable coupled to the connector according to the exemplary embodiment of the present invention. FIG. 4 shows a part of the flat cable 100 to which the connector may be coupled, the insertion bores 120 formed to allow the position fixing bosses of the retainer to be inserted into the insertion bores 120, and the conductors 110 exposed by removing the covering material from the flat cable 100. The exposed conductors 110 of the flat cable 100 may be disposed at portions of the cable (E.g., second portions) that contact opposite surfaces of the body 211 of the retainer 210, and some of the parallel conductors of the flat cable 100, that is, some sections (e.g., sections to which the terminals may be to be connected) of the cable coupled to the connector 200 may be exposed. Thus, the exposed conductors 110 may also be disposed in parallel to each other by a predetermined separation.

Furthermore, the insertion bores 120 may be disposed between the arrangements of the two exposed conductors 110 that contact the opposite surfaces of the body 211 of the retainer 210. The housing 220 may have a shape that accommodates the body 211 of the retainer 210 and the flat cable covering the body 211. The body 211 of the retainer 210 and the flat cable 100 may be coupled to each other while the position fixing bosses 212 may be inserted into the insertion bores 120 during assembly, and the body 211 of the retainer 210 and the flat cable 100 may be inserted into the housing 220 to be assembled.

The housing 220 may be configured to fix the flat cable 100 by attaching the flat cable to the retainer while protecting the flat cable 100 coupled to the retainer 210. In addition, the housing may have a case shape folded into a U shape and may enclose both the opposite surfaces of the flat cable 100 positioned on the body 211 of the retainer 210. In other words, the housing 220 may have a case shape that may accommodate the body 211 of the retainer 210 and portions of the flat cable 100 coupled thereto, and may enclose the body accommodated within the housing and the flat cable while the body and the flat cable is inserted into the housing. Thus, the housing 220 may have a shape whose surfaces contact the opposite surfaces of the flat cable 100, and exposure depressions 221 (see FIG. 2) for exposing the exposed conductors 110 of the flat cable 100 to the exterior for connection to the terminal may be formed on opposite surfaces of the housing 220.

A plurality of exposure depressions 221 may be formed to individually expose the parallel conductors 110 (e.g., exposed conductors) of the flat cable 100 on the opposite surfaces of the housing 220. Then, the exposure depressions 211 may be formed lengthily within the housing to expose substantially the entire exposed conductors 110 lengthily (e.g., in a lengthwise manner) to the exterior of the housing 220. The exposure depressions 221 on the opposite surfaces of the housing 220 may be formed lengthily as a substantially straight line along a direction in which the connector 200 (e.g., male connector) according to the exemplary embodiment of the present invention may be inserted into a female connector for connection to the terminal 300 (see FIG. 8), that is, along a coupling direction to the terminal 300 and a lengthwise direction of the exposed conductors 110. The exposure depressions 221 on the opposite surfaces of the housing 220 may be formed to be disposed in parallel to each other along a widthwise direction of the flat cable 100 at a predetermined separation.

Further, a plurality of guides 222 in the form of partitions may be formed between the neighboring exposure depressions 221 of the housing 220, and the guides 222 that protrude from the left and right sides of the insertion locations of the terminals may be configured to prevent the terminals 300 from being inserted incorrectly. The guides 222 may prevent a defective contact of the flat cable and the terminals. In other words, the guides 222 which may be partition parts between the neighboring exposure depressions 221, and may be configured to guide the lengthily formed terminals 300 when the plurality of terminals 300 disposed in parallel in the female connector may be inserted into the exposure depressions 221 (see FIG. 2) of the housing 220 for connection to the conductors 110 (see FIG. 8).

Accordingly, during the connection of the terminals, after being inserted into the exposure depressions 221 divided by the guides 222, the terminals 300 may be slid on the flat cable 100 and guided by the guides 222. Since the guides 222 may protrude from the flat cable 100 disposed within the housing 220 and surfaces of the exposed conductors 110, the terminals 300 inserted into the insertion bores 221 for connection may be more stably guided by the guides 222. The housing 220 having the protruding guides 222 may be configured to protect the conductors 110 to prevent damage to the conductors 110 during drop thereof while being assembled with the retainer 210 such that the exposed conductors 110 of the flat cable 100 may be enclosed.

Moreover, fixing apertures 223 may be formed in the housing 220 to allow the position fixing bosses 212 of the retainer 210 to be inserted into the fixing apertures 223, and the fixing apertures may be formed at an end of the housing 220 at a predetermined separation. For example, the position fixing bosses 212 of the retainer 210 inserted into the insertion bores 120 of the flat cable 100 may operate as a position fixing unit configured to fix the flat cable 100 in the connector 200 according to the exemplary embodiment of the present invention, and the position fixing bosses 212 may pass though the insertion bores 120 of the flat cable 100 and may be inserted into the fixing apertures 223 of the housing 220.

In particular, a plurality of position fixing bosses 212 may be disposed at an end of the retainer 210 (e.g., an end of the body) covered by the flat cable 100 along a widthwise direction of the retainer (e.g., the same direction as a widthwise direction of the flat cable) at a predetermined separation, and a plurality of fixing apertures 223 may be disposed on the corresponding surface of an end of the retailer of the housing 220 by a predetermined separation. A plurality of coupling hooks 224 coupled to the flange 213 of the retainer 210 may be formed at opposite widthwise ends of the housing 220 as a coupling unit for coupling the housing and the retainer. The coupling hooks 224 may be shaped to be caught by the flange 213 (e.g., connected to) while the flange 213 is inserted into the coupling unit 214 having a recess shape.

Figure 6:
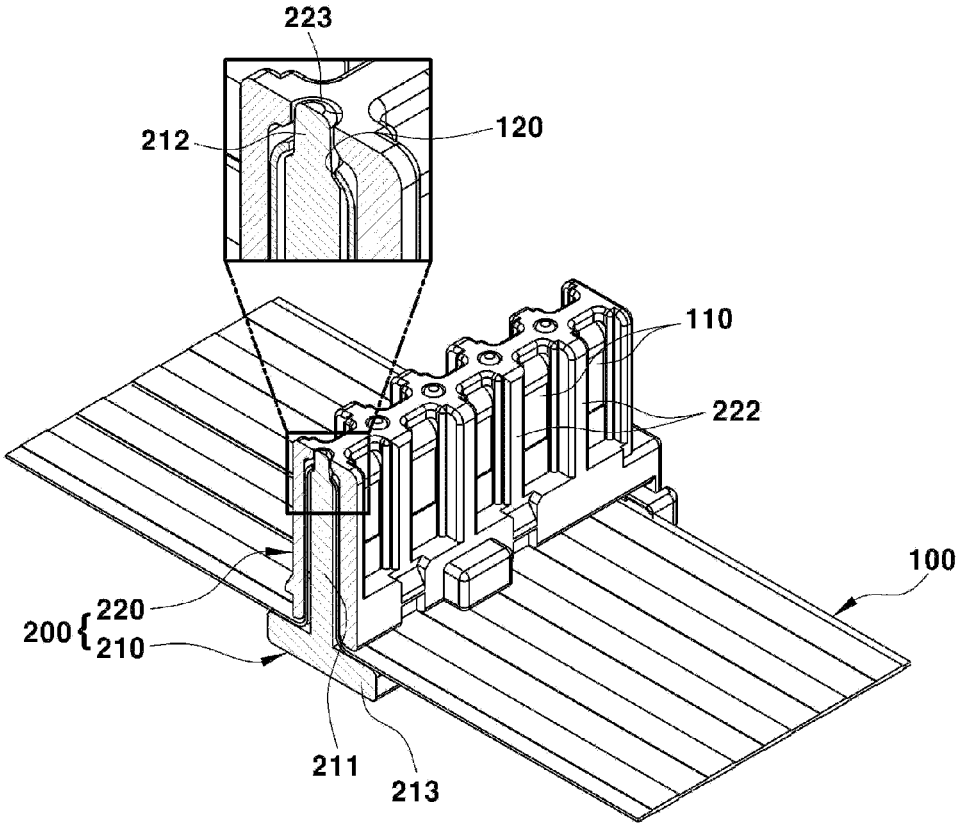
FIG. 6 is an exemplary partially sectional view showing the connector for a flat cable according to the exemplary embodiment of the present invention.
Figure 7:
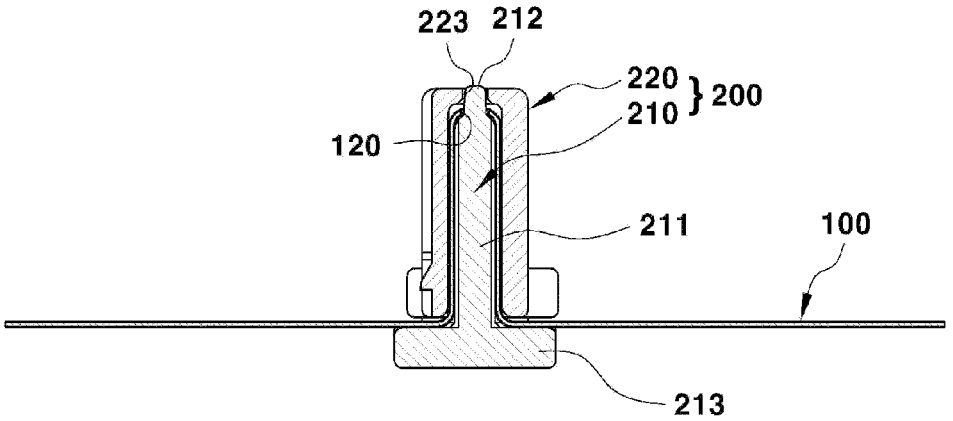
FIG. 7 is an exemplary sectional view showing the connector, to illustrate a coupling state of the flat cable according to the exemplary embodiment of the present invention.

FIGS. 5A to 5E are exemplary views showing a process of assembling the connector and the flat cable according to the exemplary embodiment of the present invention. FIG. 6 is an exemplary partially sectional view showing the connector for a flat cable according to the exemplary embodiment of the present invention. FIG. 7 is an exemplary sectional view showing the connector, to illustrate a coupling state of the flat cable according to the exemplary embodiment of the present invention.

In the assembly process, after the position fixing bosses 212 of the retainer 210 are inserted into the insertion bores 120 of the flat cable 100 having the exposed conductors 110, the housing 220 may cover the retainer 210 to allow the body 211 of the retainer 210 to be inserted into the housing 220. Then, the flat cable 100 may be folded into a U-shaped form within the housing 220, and when the coupling hooks 224 are assembled within the housing 220 to be caught by the flange 213 of the retainer 210, the position fixing bosses 212 of the retainer 210 may be fixedly inserted into the fixing apertures 223 of the housing 220. As a result, the flat cable 100 coupled to the retainer 210 may be sufficiently fixed by the position fixing bosses 212 to prevent movement of the flat cable 100 within the housing 220, and in particular, the position fixing bosses 212 may prevent the flat cable 100 from moving lengthwise between the housing 220 and the retainer 210.

As shown in FIG. 6, since the guides 222 of the housing 220, that is, the partitions of the housing 220 disposed in a space between the conductors 100 of the flat cable 100 may attach the flat cable 100 to the retainer 210, the flat cable 100 may be maintained in a fixed state while being uniformly positioned without being floated or pushed from a surface of the retainer 210 and may form a more stable contact with the terminals.

As shown, the flat cable 100 may be protected in an interior of the housing 220, and in particular, since a thickness of the housing 220, in particular, a thickness of the guides 222 (partition parts) is of a predetermined measurement, the conductors 110 of the flat cable 100 may be safely protected even when the connector 200 drops or collides with another object while the flat cable 100 is assembled. The conductors 110 exposed from the opposite surfaces of the folded flat cable 100 may be exposed to the exterior through the exposure depressions 221 of the housing 220, and when the terminals of the female connector are inserted into the exposure depressions 221 of the housing 220, the flat cable 100 may be electrically connected while the conductors 110 and the terminal 300 are connected to each other.

FIG. 8 is an exemplary view of the terminals connected to the connector according to the exemplary embodiment of the present invention. When the terminals 300 are slid after being inserted into the exposure depressions 221 of the housing 220, the terminals 300 may be electrically connected to the conductors 110 of the flat cable 100 exposed to the opposite surfaces of the housing 220 while being inserted into the exposure depressions 221. Then, two contacts may be formed between the flat cable 100 and the terminals 300, and the flat cable and the terminals may more stably contact each other due to the two contact structure to improve contact reliability between the flat cable and the terminals.

In the connector 200 according to the exemplary embodiment of the present invention, a coupled structure of the retainer 210 and the housing 220 may be a structure having a function of a joint connector 200. In other words, since the connector 200 according to the exemplary embodiment of the present invention may have a structure in which one terminal 300 may be connected to the conductor 110 of the flat cable 100 exposed to the opposite surfaces thereof, the connector 200 may be configured to distribute and output input values generated in the terminals 300 to opposite sides of the flat cable 100. An electrical signal may be branched out while taking the terminals 300 as an input and opposite sides of the flat cable 100 with respect to the connector 200 as an output. When the number and arrangement of the conductors 110 of the flat cable 100 and the terminals 300 are changed, other circuit connections may be configured, which may serve to classify the units when they are actually applied.

Although the exemplary embodiment of the present invention has been described until now, the scope of the present invention is not limited thereto, but various modifications and improvements of the basic concept of the present invention defined by the claims by those skilled in the art also fall within the scope of the present invention.

What is claimed is:

1. A connector for a flat cable, comprising:

a retainer coupled to the flat cable, wherein a portion of the flat cable covers an upper side of a plate-shaped body of the retainer;

a housing coupled to enclose the body of the retainer and the portion of the flat cable coupled to the body and having a plurality of exposure depressions configured to expose exposed conductors at a portion of the flat cable coupled to opposite surfaces of the body to the exterior to connect the conductors to terminals; and a position fixing unit configured to fix a position of the flat cable coupled between the housing and the retainer, wherein the position fixing unit includes a plurality of position fixing bosses formed in the body of the retainer to be inserted into the insertion bores of the flat cable, and the position fixing bosses are inserted into fixing apertures that pass through the insertion bores of the flat cable and fixing apertures formed in the housing.

2. The connector of claim 1, wherein the housing has a case shape that accommodates the body of the retainer and the portion of the flat cable coupled to the body, and is coupled to the retainer and the flat cable such that the body of the retainer and the portion of the flat cable are entirely enclosed by the housing.

3. The connector of claim 2, wherein the exposure depressions of the housing are formed on opposite surfaces of the housing such that the exposed conductors at the portion of the flat cable coupled to opposite surfaces of the body of the retainer are exposed.

4. The connector of claim 2, wherein the exposure depressions of the housing are formed along a lengthwise direction of the exposed conductors at the second portion of the flat cable, and the exposure depressions are formed in parallel to expose the parallel conductors at the portion of the flat cable coupled to the body.

5. The connector of claim 4, wherein partition parts between neighboring exposure depressions of the housing are formed as a substantially straight line, and the partition parts are configured to guide the terminals when the terminals are inserted into the exposure depressions for connection to the conductors within the housing.

6. The connector of claim 5, wherein the partition parts of the housing are configured to attach the flat cable disposed within the housing to the body of the retainer.

7. The connector of claim 1, wherein the position fixing bosses are formed at an end of the body of the retainer covered by the flat cable along a widthwise direction of the body at a predetermined separation, and the fixing apertures are formed in the housing on a corresponding surface of the end of the body at a predetermined separation.

8. The connector of claim 1, wherein the retainer includes:

a body inserted into and coupled to the housing, wherein the body is plate-shaped to allow the portion of the flat cable to be folded into a U shape to be attached and coupled to the body between the housing and the body; and a flange integrally formed with one side of the body and coupled to the housing.

* * * * *